United States Patent [19]

von Platen

[11] 4,084,408

[45] Apr. 18, 1978

[54] METHOD OF RECOVERING ENERGY BY MEANS OF A CYCLIC THERMODYNAMIC PROCESS

[75] Inventor: Baltzar von Platen, Ystad, Sweden

[73] Assignee: Fondation Cum Plate, Vaduz, Liechtenstein

[21] Appl. No.: 656,305

[22] Filed: Feb. 9, 1976

Related U.S. Application Data

[63] Continuation of Ser. No. 510,616, Sep. 30, 1974, abandoned.

[51] Int. Cl.[2] ..... F25B 3/00

[52] U.S. Cl. ..... 62/467 R; 62/499; 60/649; 60/673; 60/721

[58] Field of Search ..... 62/467, 499; 60/649, 60/673, 674, 721, 643, 645

[56] References Cited

U.S. PATENT DOCUMENTS

| | | | |
|---|---|---|---|
| 3,808,828 | 5/1974 | Kantor | 62/499 X |
| 3,896,635 | 7/1975 | Stewart | 62/499 |

*Primary Examiner*—Allen M. Ostrager
*Attorney, Agent, or Firm*—Eric Y. Munson

[57] ABSTRACT

A method of recovering energy by means of a cyclic thermodynamic process which is induced by means of a medium comprising at least two substances or groups of substances, one of which substances is separated from the other at a point w′ defining a first thermodynamic parameter of the medium and combined with the other one of said substances at a second point w″ defining second thermodynamic parameter of the medium while a differential in total pressure of the medium is maintained between the two points. The separation and combination of the two substances are induced by diffusion whereby one of the substances or groups of substances is diffused out of the other one of the substances or groups of substances at the first point and diffused into the other substances at the second point. The method contemplates particularly the recovery of energy from a heat reservoir of lower temperature by means of a cyclic thermodynamic process and has particular application to steam engines, refrigeration plants and heat pumps for the purpose of increasing the efficiency thereof and is based upon the concept of combining two processes one of which produces work and the other of which absorbs work.

17 Claims, 16 Drawing Figures

METHOD OF RECOVERING ENERGY BY MEANS OF A CYCLIC THERMODYNAMIC PROCESS

This is a continuation, of application Ser. No. 510,616 filed 9/30/74, now abandoned.

BACKGROUND OF THE INVENTION

In 1850 the German physicist Clausius formulated a proposition which has become known as the second law of thermodynamics. According to this well known theory, heat cannot of itself pass from a lower to a higher temperature, nor can it transform itself into useful work. The theory implies a negation by exclusion, namely that perpetual motion of the second order is not possible.

It is now known and accepted that entropy-reducing processes — i.e. perpetual motion processes — exist not only in imaginary experiments but also in reality. According to Clausius' theory, however, such a process must, by nature, always be combined with or join an entropy-increasing, destructive process which, according to his theory, must dominate and so undo that which the former process would achieve.

SUMMARY OF THE INVENTION

The destructive process, according to the aforementioned theory, always has shown itself to be dominant, for otherwise the two processes in combination would constitute second-order perpetual motion, which is unknown. The following description will show how two such processes may be combined in accordance with the invention and that it will appear likely, at least theoretically, that the destructive entropy-increasing process is also dominant in this case, and for that reason second-order perpetual motion will not occur. It has been established with certainty, however, that the invention makes possible the construction of a steam engine, refrigeration plant or heat pump of significantly greater efficiency than any such machine presently known, since the entropy-reducing process assists the entropy-increasing process.

The destructive entropy-increasing process is carried out by known mechanical means such as pistons, cylinders, etc. To describe and illustrate these devices more than absolutely necessary would tend only to obscure the most interesting part of the invention, namely that which is related to the second law of thermodynamics. The following description will therefore be confined mostly to the latter. The well known devices already mentioned will merely be indicated schematically. They are not shown at all in FIG. 15, which represents a practical adaptation, since it is assumed here that the second law of thermodynamics is dominant - an assumption which may be allowed to stand until the theoretical description accompanied by the extremely important FIGS. 7 and 8 can be shown to be faulty. The theoretical description relating to the first five figures is also an important proof that the proposition upon which the invention is based, is correct. Nevertheless, the description relating to FIGS. 7 and 8 may if so desired, be studied without reference to FIGS. 1–5.

In the physics of entropy-reducing second law of thermodynamics processes giving out work, one important detail may be noted, namely that diffusion between two or more substances always occurs. In a process such as that represented by the first five figures, the path of diffusion is extremely short, or in the order of a fraction of a millimeter. In a process such as that represented by any of the other figures, it is many times longer, and in that of FIG. 6, of example, is conveniently about 1 cm. The invention contemplates a method for recovering energy by means of a cyclic thermodynamic process induced with the aid of at least two substances or groups of substances A and B, where A is caused to diffuse out of B at a point $u'$ and to diffuse into B at a point $u''$ — the sum of the individual pressures of A and B. i.e. the total pressure, is so regulated that a difference arises between the total pressures at points $u'$ and $u''$, the sign and magnitude of this difference being so chosen that the said cyclic process in theory at least tends to quality a perpetual motion of the second order.

BRIEF DESCRIPTION OF THE DRAWING

The invention will now be described with reference to FIGS. 1–16. For reasons already stated, the first 14 figures are schematic, while

FIG. 15 shows a practical realization of a machine according to the invention, in which heat is conducted to and from the machine in a manner different from that shown in FIG. 14.

FIG. 16 shows a detail in FIG. 15.

DESCRIPTION OF AN EMBODIMENT OF THE INVENTION

Figure 1:
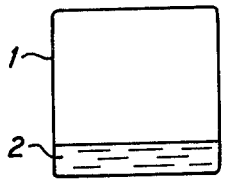
FIGS. 1 and 3 contribute to a theoretical explanation of the invention.

Assume that we have a sealed vessel or cylinder 1 in FIG. 1. A small quantity of liquid 2 such as ammonia lies at the bottom of this vessel. The space above this liquid in the vessel 1 contains only gaseous ammonia. Ammonia molecules in the gaseous state are designated $\alpha$-molecules. Of course, molecules constantly change places between the gaseous and liquid states, but in the present consideration this is not a significant phenomenon and we may disregard it.

We will now imagine that a thin gold foil (for example) is made to cover the free surface of the liquid. We then pump into the system an inert gas, for example nitrogen. Only a relatively low nitrogen pressure is required, say 20 atmospheres, but partly in order that the effect we will describe shall be clearly discernible and partly for reasons which will arise in connection with FIG. 2, we shall assume a final pressure of the order of several hundred or about 1000 atmospheres. The temperature of the system remains unaltered, i.e. room temperature. We now imagine that we remove the foil. At once we observe a fall in pressure within the system as a result of the evaporation of liquid ammonia into the nitrogen. At this pressure then, the nitrogen behaves as a solvent for gaseous ammonia. The volume of liquid ammonia decreases by a certain amount which we shall call $\Delta v$, and the gas-occupied volume increases by the same amount. The nitrogen therefore expands and its pressure falls. Since the nitrogen pressure is dominant, the pressure in the whole system falls in spite of a rise in the partial pressure of the gaseous ammonia. Those ammonia molecules which have now found their way into the gaseous state, are designated $\beta$-molecules. Solubility of nitrogen in liquid ammonia can be assumed to be nil, or alternatively we may assume that the remaining quantity of liquid ammonia is infinitessimal.

It is fully in accord with Le Chatelier's principle that evaporation of the liquid ammonia and diffusion of the gaseous ammonia into the nitrogen should be accompanied by a fall in pressure. This fall in pressure takes place so that the total rise in pressure as the nitrogen is pumped into the system shall remain as little as possible.

If, when the foil has been removed from the surface of the fluid, the total pressure in the system is maintained at a constant value by means of (for example) a piston, the volume will decrease and the specific weight of the system will rise correspondingly. If in some way the $\beta$-molecules are forced back into the fluid state, the volume will increase and the specific weight fall.

Figure 2:
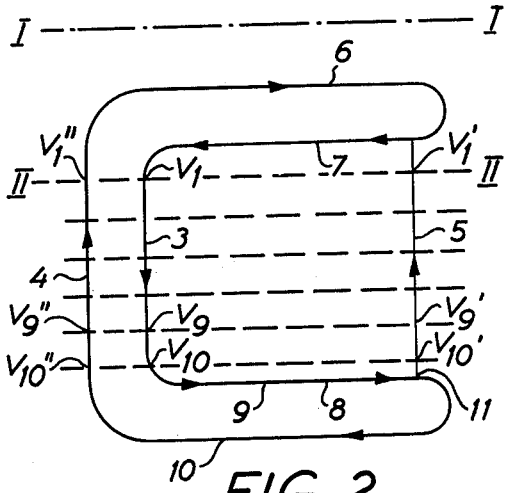
FIG. 2 shows schematically how a machine might be constructed, which functions according to the principles described in connection with the figures just mentioned.

We should now apply the above to the physical sequence of a machine whose construction is shown schematically in FIG. 2. Each continuous line in this figure represents a channel. I—I is an axis about which the machine rotates at high speed. Thus the contents of the machine lie in an extremely intense force-field. We shall assume that this is of the order of 100,000 g at the farthest distance from the axis. No energy is required to keep the machine rotating, if we discount a small loss through friction. We may assume that channels 6 and 7 are approximately the same distance radially from the said axis of rotation, and channels 8 and 10 also.

The machine contains the said substances A and B. Assume that A is ammonia and B an inert gas of suitable mean molecular weight. A mixture of nitrogen and sulphur hexafluorid will be satisfactory. We also assume (for reasons to be shown shortly) that the contents of the machine flow in the directions indicated by the arrows in FIG. 2. The pressure near the axis of rotation is assured to be about 200 atm., and at the periphery about 1000 atm. We assume that the inert gas B plus some ammonia A passes through channel 4 towards the centre of rotation and that liquid ammonia flows through channel 5 in the same direction. The gas mixture continues along channel 6 which is parallel to the axis of rotation. From here it passes into channel 7 where it meets the liquid ammonia, which has entered channel 7 from channel 5. Here the ammonia evaporates in the inert gas, wherewith ambient heat is absorbed and cooling occurs. The contact surface here between liquid and gas is the point $u''$ mentioned previously. The inert gas and gaseous ammonia now pass outwards from the centre of rotation through channel 3, accompanied by a rise in pressure and temperature. The change of state is adiabatic if channels 3 and 4 are thermally insulated from each other. We will assume for the time being that they are so insulated. The gas mixture passes from channel 3 into channel 8. Moving towards a point 9, the temperature of the gas mixture falls in consequence of close thermal contact between channel 8 and channel 10. From point 9 to point 11 the temperature falls in consequence of heat loss to the surroundings which are at a lower temperature. At point 9 the ammonia begins to condense. The heat released by condensation is emitted between said points 9 and 11. This contact surface between liquid and gas is the point $u'$, also previously mentioned. At point 11 the fluid ammonia separates off. Since it is lighter than the inert gas, it flows towards the axis of rotation I—I through channel 5. The temperature at point 11 may be assumed to be equal to or slightly higher than that of the surroundings, while at point 9 it is a good deal higher. The inert gas, now impoverished of ammonia, continues through channel 10 where it is reheated, channels 8 and 10 functioning together as a heat-exchanger. The gas having been reheated, it passes into channel 4 and so moves in towards the axis of rotation I-I, cooling adiabatically as it does so. It passes thence through channel 6 (as already described) and comes together with the ammonia once again in channel 7.

Channel 5 can be placed in thermal contact with channels 8 and 3 and also with channel 7, this arrangement winning certain advantages. This is not relevant ot the present consideration however and is merely mentioned in passing.

We shall now show how circulation in the machine, as described, can occur spontaneously. A number of lines II—II are drawn in FIG. 2, all parallel to the axis of rotation I—I and cutting channels 3, 4 and 5. At the point where the first line II—II cuts channel 3 (the first line II—II being nearest the axis of rotation I—I) we observe a very small, though not infinitesimal mass $q$ of the gas-mixture. Its volume is $v_1$ and thus its specific weight is $q/v_1$. When this mass of gas-mixture passes through channel S, fluid ammonia separates off and flows in through channel 5 towards the axis of rotation. This mass of fluid ammonia we shall call $q'$ and the remaining mass of gas-mixture $q''$. Thus $q = q' + q''$. At points where any of the lines II—II cut channels 5 and 4 we find masses $q'$ and $q''$ respectively. And at the points where any of the lines II–II cut channel 3 we fine masses $q$ which, taken in order outwards from the axis of rotation, occupy volumes $v_1$, $v_2$, $v_3$ etc. out to the periphery where we have marked the volume $v_{10}$. At the corresponding points in channel 5 the masses $q'$ occupy volumes $v_1'$, $v_2'$, $v_3'$ etc. out to $v'_{10}$ at the periphery, and at the corresponding points in channel 4 the masses q'' occupy volumes $v_1''$, $v_2''$, $v_3''$ etc. out to $v_{10}''$ at the periphery.

It clearly follows from the discription relating to FIG. 1 that $$v_{10}' + v_{10}'' > v_{10}$$

$v_{10}''$ in fact contains no $\beta$ -molecules at all. These have separated in liquid state at point 11 and thus comprise the volume $v_{10}'$. The above expression holds true even if some $\alpha$ -molecules accompany the condensate, that is to say if there is a shortage of $\alpha$ -molecules in $v_{10}''$, since the pressure of the inert gas is of a higher order of magnitude than the independent pressure of the ammonia. On the other hand, conditions close to the axis of rotation I—I are quite different. At the temperature which obtains here, the independent pressure of the inert gas is of the same order as that of the saturated ammonia vapour. Thus in the proximity of the axis of rotation I—I the shortage of $\alpha$ -molecules in channel 4 brings about a substantial decrease in volume, giving $$v_1' + v_1'' < v_1$$

Thus a force capable of propelling the gasses through channels 3, 8, 10, 4, 6 and 7 is generated in the peripheral parts of the system. This force decreases towards the centre and as a general rule changes sign somewhere between the periphery and the centre. If this takes place, is a function of the pressure and molecular weight of the inert gas. Pressure at the periphery however must not rise above a certain value or the ammonia will not condense. The system is thus fairly complex. The following is a simpler exposition.

Let us now suppose the machine in FIG. 2 contains only a convenient quantity of ammonia. As before, the machine rotates at high speed. We now pump into it an inert gas-mixture of suitable mean molecular weight. What is meant here by "suitable" will appear shortly. We pump in a certain quantity of gas until we observe that the fluid ammonia has climbed up channel 5 as far as channel 7, when we stop pumping. Now the centrifugal force on the columns of gas in channels 3 and 4 are equal to or slightly greater than the centrifugal force on the column of liquid in channel 5. Since we have chosen a suitable value for the mean molecular weight of the inert gas-mixture, we will further note that the centrifugal force on the gas column in channel 3 is just a trifle greater than that on channel 4. Yet it is enough to overcome flow resistance in the system. The difference between the two forces is identical to the propelling force that overcomes frictional and flow resistance. Thus the lower the chosen molecular weight, the greater this force will be. But since the centrifugal forces are enormous compared to the flow resitance, the mean molecular weight must be fairly accurately fixed. By means of the process we have just described, heat passes from a lower temperature near the axis of rotation, to a higher temperature at the periphery.

It may also be of great interest to study what occurs if the process is carried on isothermally, or to be more precise, at the ambient temperature. In this case a fine mist of fluid ammonia will form in channel 3 as the gases come under increasing pressure on their way out towards the periphery. We can assume that this mist is carried along in the gas stream beyond the point where the specific weight of the inert gas equals that of the fluid ammonia. Beyond that point of course (that is to say nearer the periphery) the specific weight of the gas-mixture is greater than that of the fluid ammonia. So we may assume that the fluid ammonia, as before, separates off at point 11 and flows through channel 5 towards the centre. The ammonia-impoverished inert gas passes through channel 4 towards the centre for the same reasons as before. Thus the events we have described previously also take place at ambient temperature. In this instance the only benefit we can derive from such a machine is mechanical work. The machine can produce work in two distinct ways, or in both ways at once. In one case the mean molecular weight of the gas mixture is so chosen that the amount of mechanical work apportioned to the gas is just sufficient to maintain circulation. The mean density of the gas is high so that the centrifugal force on the gas columns in channels 3 and 4 is significantly greater than that on the liquid column in channel 5. The liquid is thus propelled in towards the centre with great force and can therefore transmit work to a piston pump or turbine. In the other case an inert gas is chosen with the lowest possible mean molecular weight. Its density however must be great enough to enable the liquid in channel 5 to reach up to channel 7. The gas column in channel 4 will be significantly lighter than that in channel 3, so that the gas will circulate with great force and can transmit mechanical work to a pump or turbine.

We suppose the temperature continues, as before, to be the same throughout the machine. In channel 7 where the pressure of the inert gas is low, ambient heat is absorbed as the fluid ammonia evaporates. In channel 3 (we may disregard channel 8 in this instance) gaseous ammonia condenses in the presence of inert gas which is at considerably greater pressure than in channel 7. With condensation, heat is emitted to the surroundings. We may disregard the absorbtion and emission of heat taking place in the inert gas alone, since the process was assumed to be isothermal, and at ambient temperature. It is expected that condensation heat emitted in the presence of an inert gas becomes less, the greater the independent pressure of the gas. More heat must then be absorbed when the ammonia evaporates in channel 7, than is emitted when it condenses in channel 3. This difference is identical with the work done, expressed in units of heat, by the piston machinery or turbine.

It is now known that condensation heat diminishes as the pressure of the inert gas increases. This seems to be an encouraging sign for the value of our hypothesis. Also relevant to this theme is another isothermal process, which we will describe.

Figure 3:
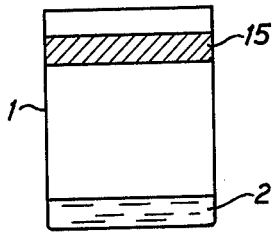

FIG. 3 represents a cylinder 1 closed by a movable piston 15. In the lower part of the cylinder is a small amount of liquid ammonia. The cylinder also contains inert gas. So that the liquid ammonia will remain at the bottom of the cylinder and not flow upwards when the pressure increases, we assume that the inert gas is light — say helium. The total pressure in the cylinder, when the piston is in the position shown in FIG. 3, can be 200 atm. This state is represented by point a in the pv-graph FIG. 4. The gas volume contains both helium molecules and ammonia molecules, the latter being differentiated as before into $\alpha$ -molecules and $\beta$ -molecules.

We now drive the piston into the cylinder, keeping the temperature constant. The ensuing change of state is shown on the pv-graph FIG. 4 by the curve *abc*. At *c* the mass of fluid ammonia at the bottom of cylinder 1 is greater than at *a*, ammonia having condensed out under the increased pressure.

Imagine now that we can cover the free surface of the liquid with a gold foil. This done, we allow the piston 15 to move out. AT *c*, or course, $\beta$ -molecules were also present in the gas, and since the foil now prevents any evaporation of the liquid, these $\beta$ -molecules quickly become a $\beta$ -molecules as expansion takes place. At *d* on the curve all the $\beta$ -molecules have been transformed. Here then, we have the same number of ammonia molecules per unit volume as in dry saturated ammonia vapour at the same temperature. In this state, point *d*, we now imagine that we prick a small hole in the foil which will permit diffusion of just sufficient molecules to ensure that the mass per unit volume of gaseous ammonia remains constant, as the piston continues to move out. Thus during the change of state *d* – *e* in FIG. 4 there is a full complement of $\alpha$ -molecules present in the gaseous state but no $\beta$ -molecules at all. As in the case of FIG. 1, the total pressure during the change of state *d* –

*e* is higher than during *b* – *a*. For the same reason it is also higher during *c* – *d* than during *c* – *b*.

Figure 4:
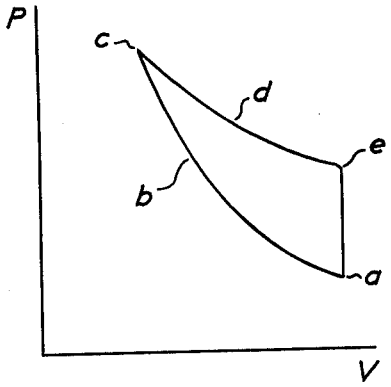
FIGS. 4 and 5 are graphs relating to said FIGS. 1 and 3.

When the state has reached *e* in FIG. 4 we remove the foil. A quantity of liquid then evaporates, that is to say gaseous ammonia dissolves in the helium, i.e. $\beta$ -molecules find their way into it. The change of state here will be *e* – *a* in FIG. 4, i.e. a fall in pressure at constant total volume. The perpetual motion work released is then equal to the area *a –b–c–d–e–a*. This work implies that there is an absorbtion of heat from the surroundings. It is easy to understand how this occurs. When the volume diminishes, *a* – *b* – *c*, ammonia condenses all the while. When the volume increases, *c* – *d* – *e*, only some of the ammonia evaporates. During *c* – *d* of course, there is no evaporation at all, and during *d* – *e* only so much that the number of a -molecules per unit volume remains constant. The pressure in the inert gas is thus greater during condensation than during evaporation, and therefore (as we know) the heat lost to the surroundings in condensation must be less than the heat gained in evaporation.

Figure 5:
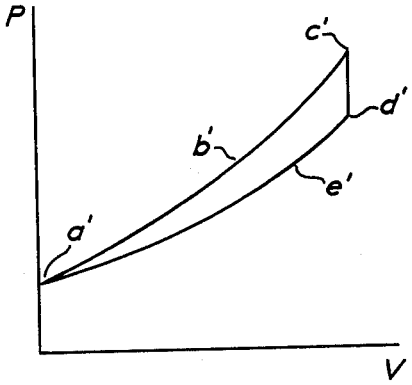

In FIG. 5 the abscissa v shows the volume of liquid 2 in the cyclic process described with reference to FIG. 4 and as before, the ordinate p is the total pressure, i.e. the liquid pressure. In FIG. 5 points *a'*, *b'*, *c'*, *d'*, *e'* correspond to *a*, *b*, *c*, *d*, *e* in FIG. 4.

It is therefore conceivable that a perpetual motion process such as that indicated by the graph in FIG. 4 could theoretically be possible at the lowest pressure one cares to choose for the inert gas. The lower this pressure is, however, the more difficult it is to make process function. On the other hand, the pressure may not exceed a certain value or the ammonia will not condense. We have, of course, only chosen ammonia as an example.

The process represented in FIGS. 3 and 4 can also be explained in another, perhaps simpler way. We begin the process at point e in FIG. 4. We have the cylinder 1 and piston 15 (FIG. 3). At the bottom of the cylinder 1 is a small quantity $q_x$ of fluid ammonia 2. Thus the volume between liquid and piston contains only $\alpha$-molecules. We lay a thin gold foil over the surface of the liquid. We then pump helium (for example) into the chamber, the total pressure rising to e.g. 200 atm. Escape of $\beta$-molecules into the gaseous state is prevented by the gold foil. All this takes place at constant — e.g. room — temperature. Now we remove the gold foil. $\beta$-molecules immediately disperse into the gaseous state. The quantity of liquid $q_x$ is so chosen that when equilibrium has been reached almost all the liquid has evaporated, there remaining only a vanishingly small though not infinitessimal quantity at the bottom of the chamber. The position of the piston has until now remained unchanged. As instanced previously in connection with Le Chatelier's principle, when evaporation takes place, total pressure falls. When equilibrium is reached, total volume having remained constant, total pressure will have fallen from *e* to *a* in FIG. 4.

We now drive in piston 15. Note that in accordance with what has previously been said, this may be done at any total pressure chosen within wide limits. The ammonia condenses. Point *c* in FIG. 4 is so chosen that when it is reached, the exact quantity $q_x$ of ammonia has condensed. We now lay the gold foil once more over the surface of the liquid, and then allow the piston to return to its original position. Clearly we have now reached point e where we started the process. Once again we remove the foil, wherewith $\beta$-molecules immediately disperse into the gaseous state. When equilibrium has been reached, and only a vanishingly small though not infinitessimal quantity of liquid remains (in accord with what has just been said), we have arrived at point *a*. Thus, perpetual motion work of the second order *e* – *a* – *c* – *e* has been released.

We return now to FIG. 2. If the pressure in this machine is below a certain value or if the mean molecular weight of the inert gas is chosen wrongly, we may still get perpetual motion work from the machine of the order of the second law of thermodynamics if the circulation is maintained by the sacrifice of external work, i.e. if it is kept going by force. This will be less than the perpetual motion work of this order that is obtainable theoretically. In these circumstances then, the useful work produced is equal to the difference between two other quantities of work. This conclusion can only be of theoretical interest since it is simpler to choose the said pressure and mean molecular weight so that the process as described earlier shall occur spontaneously. In saying this, of course, we presuppose that no destructive, entropy-increasing process causes us to sacrifice work in maintaining the circulation.

When liquid e.g. fluid ammonia forms in the presence of the inert gas or gas mixture, a diffusion of the condensing medium A takes place close to and in the direction of the liquid. The path of this diffusion through the gas is extremely short, but exists nevertheless.

In the course of the cyclic thermodynamic process we have just described, we supposed the substance A, which oscillates between the gas and liquid state, to be ammonia. But there are many other substances to choose from. Propane ($C_3H_8$) is one of these. If pressure-temperature function, i.e. *pt*-curve, approximately coincides with that of ammonia. It molecular weight as well as vapour density is higher, and its specific weight in the liquid state lower than that of ammonia, and these characteristics contribute to a considerable lowering of total pressure in the machine. (Other suitable substances A as well as other inert gasses B can easily be found with the aid of physical tables).

The machine could have many such channels 6,7,8 and 10 (FIG. 2) placed about the axis of rotation. Alternatively (as we will show by analogy in FIGS. 14 and 15 and have therefore not included in FIG. 2) each channel may be a geometrically circular ring with rectangular cross-section. Each such geometric ring is defined by or formed from two concentric circles whose centre lies in the geometric axis I—I. The channels 6, 7, 8 and 10 thus take the form of concentric cylinders. Channels 3 and 4 may be formed from discs whose centre is also in I—I. All the channels participating in the heatexchange function, whatever geometric form they may have in cross-section, should be narrow enough to achieve a high coefficient of heat transmission between gas- or vapour-stream and solid wall.

Even if circulation in the system occurs spontaneously (perhaps against expectations, according to Clausius' theory) it may be useful to control the circulation through two pumps, one each for liquid and gas. The pumps are built into the hermetically sealed system and so absorb no work except that lost to friction. They are conveniently driven by three-phase induction motors whose armatures are also built in. If circulation does occur spontaneously "against expectations" we would have (as mentioned) a perpetual motion of the second order, which as yet is contrary to popular belief. However, regardless of the underlying theories this machine also will be more efficient than any existing refrigerator or heat pump.

Heat may be taken to and from the hermetically sealed machine with the aid of another system (presented in greater detail in connection with FIG. 14) which is fixed to the machine and rotates with it. If these rotate in very low air-pressure, unnecessary losses through friction can be avoided. This second system, whose technology is familiar, need not be hermetically sealed. A fluid oil is driven or circulates within it.

If heat is to be transferred from the high temperature of the hermetically sealed system to its low temperature, this may be done by means of an ordinary steam engine which will release useful work.

In the entropy-reducing second law of thermodynamics processes described above, we mentioned that the path of diffusion of substance A through, out of and into substance B was very short. Other such processes were mentioned, in which the path of diffusion was many times greater. These we will now describe with reference to FIGS. 6 - 16.

Figure 6:
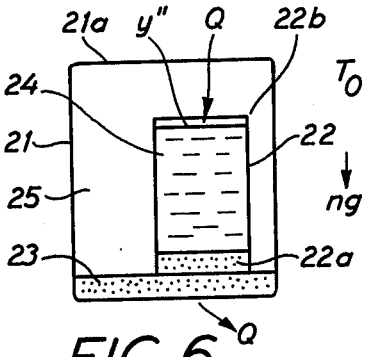
In FIGS. 6, 10, 11, 12 and 13, substance A may be propane (for example), while substance B is a gas, or mixture of gasses, which should conveniently be heavy.

FIG. 6 represents an hermetically sealed vessel 21 of convenient material e.g. steel. The vessel contains a beaker 22 of other suitable material such as glass which has low thermal conductivity. We suppose that the bottom 22*a* of beaker 22 is porous glass, china clay or other such suitable material. The beaker stands on a thin porous tile 23 which covers the bottom of the vessel 21. There is thus contact between bodies 22*a* and 23. We also suppose that the beaker 22 is filled nearly to the brim 22*b* with a suitable liquid 24 substance A. The upper surface of this liquid 24 is marked $y''$, which also designates a level. The brim 22*b* of the beaker and the surface $y''$ lie very close to the ceiling 21*a* of vessel 21. The substance A may be propane ($C_3H_8$), ammonia ($H_3N$), water et al. The remaining volume 25 of vessel 21 contains of course, gas or vapour of substance A. It also contains substance B in gaseous state. A mixture of the heavy inert gases sulphur hexafluoride $SF_6$ and xenon X is suitable. The whole device is at room temperature $T_o$ and is subject to a force-field expressed as $ng$, where $g$ is earth gravity and $n$ a variable factor. Assume that heat Q can leave the device only through the porous tile 23 and enter it only through the liquid surface $y''$. We choose the partial pressure of B so that the mean specific weight of the gas mixture in chamber 25 equals the specific weight of the liquid 24. When B is composed of said substances $SF_6$ and X, the said partial pressure is of the order of 100 atm.

Suppose that the value of $n$ is between 60.000 and 100.000, which is easily achieved centrifugally. Assume for pratical purposes that force-field $ng$ is the same throughout the inner volume of vessel 21. Suppose finally that substance A is propane ($C_3H_8$), which happens to have a fairly high molecular weight or vapour density and fairly low specific weight in liquid state.

Figure 7:
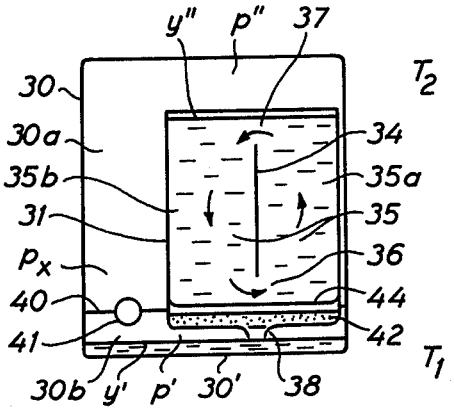
In FIGS. 7 and 8, which are of great theoretical importance, A is assumed to be ammonia, while B is a salt dissolved in the ammonia.
Figure 8:
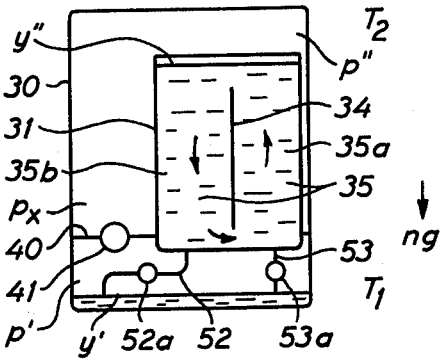
Figure 9:
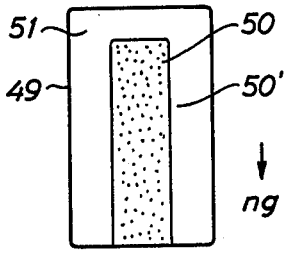
In FIG. 9, substance A may be assumed to be ammonia or some other gas which is readily adsorbed by substance B, which is here assumed to be a solid body.

For reasons which will be clarified shortly, when we consider FIGS. 7 and 8, we have the right to assume that the following can take place. The propane evaporates under partial pressure $p''$ from the surface $y''$, whose temperature in dynamic equilibrium is $T_2$. Force-field $ng$ causes propane vapour to diffuse downward through the inert gas ($SF_6$ and X) in chamber 25, following which it condenses under partial pressure $p'$ at the floor 23, whose temperature in dynamic equilibrium is $T_1$. One then has $p' > p''$ and $T_1 > T_2$. In this process, then, heat passes of itself from a lower to a higher temperature, since no work is required to maintain force-field $ng$ if we discount small frictional losses. As we have just said, this is as yet merely an assumption. But in considering FIGS. 7 and 8 we will begin to see how great is the possibility that the assumption accords with reality.

We now designate a fraction of the pressure $p'$ as $p_\beta'$, and a fraction of $p''$ as $p_\beta''$. The existence of these fractional pressures is analogous to conditions we have already described in conjunction with FIGS. 1 to 5, that is to say that $\beta$-molecules of propane are forced from the liquid into the gaseous state by the inert gas. Clearly $p_\beta' > p_\beta''$, since the pressure of the inert gas due to the action of force-field $ng$ is greater at the floor 23 than at the surface $y''$. This difference, $p_\beta' - p_\beta''$, tends to lower the temperature $T_1$ immediately above the floor 23 or, expressed another way, the propane molecules coming down from surface $y''$ have difficulty penetrating the zone immediately above the floor 23 because some of the space is already taken by the $\beta$-molecules that are generating pressure $p_\beta'$. This phenomenon appears to indicate that the molecular weights of substances A and B could be chosen relative each other so as to eliminate the effect of the second law of thermodynamics which we are trying to obtain.

As an example of substance A we named propane ($C_3H_8$) and mentioned its relatively high molecular weight. It is however considerably less than that of sulphur hexafluoride and xenon, which mixture we named as an example of substance B. We will now exchange the latter mixture for hydrogen, or hydrogen plus nitrogen ($H_2$, $N_2$). The pressure in the device, which was previously of the order of 100 atm, will now of course be several times greater since the weight of the gas column in chamber 25 must equal that of the liquid column in beaker 22. It is now easier to visualise that the propane vapour diffuses downwards through the inert gas to the floor 23 and there condenses at a higher temperature $T_1$ than the temperature $T_2$ at which it evaporated from surface $y''$. We can believe this because both hydrogen and nitrogen are considerably lighter than propane. For analogous reasons we could visualise diffusion of A against the direction of force-field $ng$ instead of with it, that is to say, evaporation at low temperature taking place at the floor 23 and condensation at higher temperature at the surface $y''$, if we simply exchange the propane for ammonia ($H_3N$) which has a low molecular weight, and use $SF_6$ and X as previously for the inert medium B. In this case the force engendered by the $\beta$-molecules is acting in the same direction as diffusion.

That said about FIG. 6, further detailed explanation is not possible due to lack of experimental data. A formula exists for deriving values of $p_\beta'$ and $p_\beta''$, but it cannot serve, partly because it is based on the assumption that Clausius' theory is generally applicable and partly because of lack of said data. FIG. 6 will, however, emerge clearly after discussion of FIGS. 7 and 8, partly because it is closely related to them and partly because a description of them is not hindered by any lack of experimental and theoretical data in the case where diffusion of A through B takes place against the direction of force-field $ng$.

The vessel 30 in FIG. 7 corresponds to vessel 21 in FIG. 6 above. In this vessel 30 is a beaker 31. The partition 34 divides the interior of the beaker into two parts, 35*a* and 35*b*. These spaces communicate with each other through the opening 36 at the bottom of partition 34 and through the opening 37 over the top of partition 34, which does not reach fully to the brim of beaker 31. Out of the bottom of beaker 31 runs a short channel 38 reaching almost to the bottom 30' of vessel 30. Chambers or channels 35a and 35b together with the partition 34 can form a heat exchanger 35. The interior of the vessel 30 outside beaker 31 is divided by a wall 40 into two parts, an upper chamber 30a and a lower 30b, which chambers are connected only by the gas pump or compressor 41. The bottom of beaker 31 is covered by a porous tile 42 whose upper surface is itself covered by a semi-permeable coating or membrane 44 which is hermetically sealed to the interior surface of beaker 31.

In this connection it may be mentioned that it is known that a liquid which is not or very little soluble in the liquid with which it is in contact, can function as a semi-permeable member. However, at least for the time being we assume that membrane 44 is a common membrane, a solid body.

Beaker 31 is almost entirely filled with a suitable liquid whose free surface $y''$ (which also denotes a level) lies between the upper edge of partition 34 and the brim of said beaker. This liquid also occupies the pores of the semi-permeable membrane 44 and the tile 42, channel 38 and, as a thin layer, the bottom of chamber 30b up to the level $y'$ which may also be described as the free surface of the liquid in that chamber. We presuppose that the two said free surfaces of the liquid are maintained by convenient means at the constant levels $y'$ and $y''$. Apart from that occupied by the liquid, the entire remaining volume of vessel 30 contains gas or the liquid vapour. We will assume (only for example) that the liquid is ammonia.

Temperature of the upper part of the vessel 30 may be denoted $T_2$, of the lower part $T_1$, and of the surroundings $T_0$. The whole apparatus is subject to a force-field $ng$.

First we take $n = 1$, i.e. the apparatus subject only to gravity, with ambient temperature throughout, $T_1 = T_2 = T_0$. We now let $T_1$ rise to e.g. 50° C and let $T_2$ sink to e.g. −10° C and in doing so we must raise $n$ from 1 to a value we will call $n_0$, which is precisely enough to keep the liquid levels $y'$ and $y''$ unaltered. Vapour pressure $p'$ of the ammonia in chamber 30b is that which obtains at the exemplary temperature $T_1$, i.e. 50° C, and this value for $p'$ will remain constant during the argument which follows. On the other hand, as we will soon show, vapour pressure $p''$ above surface $y''$ will vary. At this stage of course, $p''$ is the vapour pressure of fluid ammonia at the exemplary temperature $T_2$, i.e. −10° C. In order to maintain the value of $T_1$ and $T_2$ we now start up the pump or compressor 41. Ammonia vapour is pumped from chamber 30a and pressure $p''$ to chamber 30b and pressure $p'$. The ammonia boils away from the liquid surface $y''$, absorbing heat, and condenses at liquid surface $y'$ emitting heat. The liquid formed from condensation at temperature $T_1$ flows against the force-field $ng$ through channel 38, the porous bodies 42 and 44 and the channels 35a and 35b, finally reaching the low temperature $T_2$ where it changes to vapour. The arrangement functions just like an ordinary compressor refrigerator. We will suppose that the cycle takes place without loss and that the work required, delivered only to compressor 41, has consequently the minimum value given by Carnot's equation, which work we will call $L_c$. It should be mentioned that, for the cycle to take place without loss, liquid must pass from $T_1$ to $T_2$ by means of a reversible process which delivers a little work to the compressor 41. This consideration is elementary and so need not be amplified.

The gas compressor 41 could be exchanged for a liquid pump by which liquid ammonia in chamber 30b would be pumped into beaker 31, and in this case the gas pressure $p'$ would be generated solely by the force-field $ng$ acting on the gas in chamber 30a and, if $T_2$ is constant, $T_1$ would clearly be a function of $n$.

We shall now investigate how we can minimise the work sacrificed, or arrange that it is less than $L_c$ without, of course, reducing the quantity of heat that is to be transferred from the lower temperature $T_2$ to the higher $T_1$. In the fluid ammonia in beaker 31 we now dissolve a substance such as a salt or a mixture of two salts e.g. $LiNO_3$, NaJ, KJ, $NH_4NO_3$, $KNO_3$ $KNO_2$. Said substance may of course also be a liquid which is wholly or partially soluble in the substance A (e.g. $H_3N$). All these substances have considerably greater molecular weight than ammonia. We must of course take care that the addition of the salts does not give too great a volume of liquid in beaker 31. We arrange in some way that the liquid circulates through heat-exchanger 35 in the direction indicated, and we will assume that no heat losses occur, i.e. that it is completely efficient. The dissolved salt has a high osmotic pressure which seeks to draw liquid from the chamber 30b through the membrane 44. In order to maintain equilibrium so that the liquid level in chamber 30b will remain unaltered at $y'$ and similarly the liquid level in beaker 31 unaltered at $y''$, we must increase the value of factor $n$, say from $n_0$ to $n_1$. Now, work will be released in the heat exchanger 35 since the liquid flowing upwards through channel 35a contains a little more ammonia and therefore has a lower specific weight than the liquid flowing downwards in channel 35b. But theoretically this work can be retained and passed on to the compressor 41. For this and other physical reasons which need not be described, we may disregard this phenomenon; that is, we may fairly assume that the work dissipated by the heat-exchanger is nil or, in the case of combinations other than ammonia and a salt, that the work consumed by it is likewise nil. The apparatus described here functions in a manner equivalent to an ordinary so-called resorption refrigerator, and it follows that since no irreversible losses occur, the work that must be transferred to the compressor 41 remains constant or equal to $L_c$. Since the vapour pressure $p'$ of the pure ammonia above surface $y'$ remains unaltered, $T_1$ being constant, and since the work required by the process according to Carnot also remains unchanged, $T_2$ and the quantity of heat to be transferred from $T_2$ to $T_1$ both likewise being constant, than the pressure immediately above the compressor, $p_x$, and with it the factor $p' - p_x$ which is proportional to the work, must also remain unaltered in spite of the increase of factor $n$ from $n_0$ to $n_1$. All these conditions follow from Carnot's equation, hence a physical-chemical proof is not required. No perpetual motion process exists in this case.

We now stop circulation of the liquid in the heat-exchanger 35. We will keep factor $n$ unchanged at the value $n_1$. The salt concentration immediately above the membrane 44 now rises due to diffusion of the salt downwards under the influence of force-field $ng$. The small amount of fluid ammonia at the bottom of chamber 30b, in channel 38 and in the porous tile 42 is now drawn up through the membrance 44 into the beaker 31. Ammonia gas makes contact with the underside of membrane 44 and the liquid filling each pore in the membrane acquires a concave surface facing downwards towards chamber 30*b*. These surfaces are concave since, if menisci were to form in the downward-facing pores of the membrane 44 in the absence of diffusion, they would be plane, surface $y'$ being plane. When diffusion takes place osmotic pressure builds up, and the menisci must become concave to withstand it. The gas pressure $p'$ sinks in consequence. Salt concentration in the upper part of the beaker falls due to diffusion downwards of the salt under the influence of force-field *ng*. As a result gas pressure $p''$ increases and with it gas pressure $p_x$. Thus the difference between the pressure $p'$ and $p_x$ has been reduced and in consequence less work needs to be supplied to the compressor for it to move the same quantity of heat from $T_2$ to $T_1$. This work which we will call $L_p$ is thus less than $L_c$, which (according to what has already been stated) implies that the process comes within the second law of thermodynamics.

When $L_p$ is greater than zero but less than $L_c$ ($L_c > L_p > 0$) the process may be described as incomplete with respect to the second law of thermodynamics. When $L_p$ is equal to or less than zero ($L_p \leqq 0$) the process may be called complete. When $T_2$ is equal to $T_1$, $p_x$ is greater than $p'$ and the compressor then functions as a motor, delivering mechanical work. This also means that $L_p < 0$. It will be seen from this that, at a certain difference between $T_1$ and $T_2$, $L_p$ will equal zero. To illustrate this condition in greater detail we will now assume that the machine is functioning as a resorption refrigerator. The liquid is circulating in the heat-exchanger 35. Suppose $T_1 = T_2$. The machine is pumping heat from $T_2$ to $T_1$ but since $T_1 = T_2$ and thus $\Delta T = 0$ the work required by the pump equals zero, in accord with the ordinary laws of thermodynamics. Thus $p_x = p'$. We now stop the circulation of liquid in the heat-exchanger 35. Diffusion of the salt causes $p'$ to fall and $p''$, also $p_x$, to rise. Thus $p_x > p'$ and the compressor 41 now functions as a motor or steam engine. At a certain value for $T_1$, $p_x = p'$. The machine then delivers no work, that is, the compressor 41 no longer functions as a motor, and the machine becomes merely a refrigerator which may be qualified as a perpetual motion refrigerator of the second order.

In a case where there is no circulation in the heat-exchanger (as in the preceding paragraph) the partition 34 can be removed and the beaker 31 could contain, instead of the ammonia, a mixture of two liquids of limited solubility. This could be advantageous in certain circumstances which we will not describe in further detail. Suffice it to say that the second law of thermodynamics could also be induced in this case.

In FIG. 7 the previously mentioned point $u''$ is formed at the upper surface of membrane 44 while $u'$ clearly coincides with surface $y''$.

FIG. 8 differs only slightly from FIG. 7. Two channels 52 and 53 lead out of the bottom of beaker 31 down to the bottom of vessel 30. In each is a liquid pump 52*a* and 53*a*. One of these, say 52*a*, pumps out liquid from beaker 31 while the other pumps liquid into it, so that the liquid levels $y'$ and $y''$ remain unaltered. Suppose that the liquid is an ammonia-salt solution. Liquid is circulating in the heat-exchanger 35, compressor 41 is functioning and force-field *ng* is operative. The ammonia is absorbed at surface $y'$ and is then pumped into beaker 31 by liquid pump 53*a*. Heat is emitted at the higher temperature $T_1$ and absorbed at the lower temperature $T_2$. The process is assumed to be reversible, and so the work sacrificed is the same as the value given by Carnot, $L_c$, i.e. the difference between work demanded by 53*a* and work delivered by 52*a*, plus work demanded by compressor 41. The said difference is almost exactly equal to the work required (we will call it $L_A$) to pump the amount of ammonia in question (substance A) in fluid state, from surface $y'$ to the bottom of beaker 31. It is exactly equal to $L_A - \Delta'L$ where $\Delta'L$ is a correction term dependent upon a certain shrinkage of volume which takes place when the fluid ammonia mixes with the fluid salt solution. The mean concentration of the latter may be called C'. We now stop the circulation in heat-exchanger 35 and diffusion begins. The salt concentration of mean value C' now increases at the bottom of beaker 31 to C'', decreases at the top, and of course also increases to C'' at the bottom of vessel 30 through pump 52*a*. Suppose now that we keep pressure $p'$ unaltered. Then the difference between work supplied to pump 53*a* and work delivered by pump 52*a* also remains virtually unchanged at $L_A$ since, the force-field being constant and uniform, the hydraulic pressure at the bottom of beaker 31 is independent of diffusion. In other words (as is self-evident) a salt molecule weighs the same whether it is at the top or the bottom of the beaker or, the weight of liquid in the beaker is not dependent on the distribution of salt in it. The exact value of the difference between work demanded and supplied by the two pumps is $L_A - \Delta''L$. The correction term $\Delta''L$ is somewhat larger than the previous term $\Delta'L$, since C'' is larger than C'. The work required from the pumps is now a little less than before, so it is fair to take it as constant. This allows us to disregard the pumps 53*a* and 52*a* altoghether in the argument which follows.

Now if the gas pressure $p'$ is to remain unaltered as suggested, in spite of increased salt concentration at the bottom of beaker 31 caused by diffusion, the remperature $T_1$ must be raised, say to $\phi\ T_1$ where $\phi > 1$. But if $T_2$ is held constant at, say, ambient temperature, the gas pressure $p''$ will rise because of the decreased salt concentration in the upper part of beaker 31 similarly caused by diffusion. As $p''$ rises, $p_x$ also rises and it follows that, since $p'$ remains unaltered, the compressor 41 demands less work. Before diffusion began the work demanded by the process was that given by Carnot, $L_c$. Now the demand is less than $L_c$, and this in spite of an increase in temperature $T_1$ to $\phi T_1$.

This indicates that the process would be within the second-order perpetual motion or the second law of thermodynamics. However, in order to realize a a practical useful machine of this order there must be present, according to Clausius, a destructive process of sufficient intensity. One such destructive process results from the fact is that the diffusion resistance in a liquid is so great that in all propability no difference between $T_1$ and $T_2$ will be discernible, in which case our experiment becomes merely imaginary. But let us now make $T_1$ and $T_2$ equal. On the basis of our imaginary experiment and the argument presented with FIG. 7, we mow see that the compressor or machine 41 will deliver a quantity of work.

It should be added that the temperature $T_1$ at the bottom of vessel 30 ought strictly speaking to be given as $T_1 + \Delta T$ on the left side and $T_1 - \Delta T$ on the righ side of the vessel, where $\Delta T$ is a very small correction depending on the fact that salt concentration is a little higher on the left than on the right. During absorption the salt concentration decreases from left to right, since we assumed that liquid was flowing out of the lower end of channel 52. This variation however was of no concern in the theoretical argument accompanying FIG. 8.

In FIGS. 7 and 8 we said that the molecular weight of the dissolved substance B (one, or a couple of salts) was considerably greater than that of the solvent A, ammonia. The salt B therefore diffuses downwards in the beaker 31 under the action of force-field *ng* and then comes to rest, so that the salt concentration at the bottom of the beaker remains greater than at the surface $y''$ of the liquid, while at the same time ammonia diffuses upwards against the force-field *ng* and evaporates at the said surface. This is clearly what occurs — the cycle having its causes in simple and well-known natural phenomena. But suppose we arrange that the soluble substance B — in place of the salts — has a considerably lower molecular weight than the solvent, substance A. The concentration of B will now be greater at the surface $y''$ than at the bottom of beaker 31. So it is probable that the process will work in the opposite direction, with A evaporating below at surface $y'$ and condensing or being absorbed at surface $y''$ at a higher temperature, and thereafter diffusing down in the direction of force-field *ng* through substance B in beaker 31.

Considering the similarity between the process illustrated by FIG. 6 and those illustrated by FIGS. 7 and 8, it is probable that a perpetual motion process of the second order could be achieved in accordance with the first-named FIG. 6. In FIGS. 10, 11, 12 and 13, which are closely related to FIG. 6, we take it that diffusion of A through B occurs in the direction of the force-field, although (as mentioned) it might be convenient to reverse the direction. One has only to select the substances A and B according to requirements.

A process according to FIG. 7 could be combined with one according to FIG. 6. Suppose for example that the liquid in FIG. 7 is ammonia and a salt, and that in chamber 30*a* there is a light inert gas such as a mixture of nitrogen and hydrogen. Suppose also that the wall 40 and compressor 41 are taken away. Judging from previous considerations, it is probable that the process now induced in the liquid in beaker 31 will abet the process induced in the gas mixture in chamber 30*a*.

It is well known that a gas diffuses through another gas (as in FIG. 6, its closely related other figures and also FIGS. 1 - 5) with wastly less resistance than a liquid or salt through another liquid (as in FIGS. 7 and 8). For this reason a second law of thermodynamics process employing diffusion between gases must be considered to be technically feasable.

The theoretical arguments we put forward in connection with FIGS. 7 and 8 appear to be incontrovertible, at least when diffusion of A occurs in the opposite direction to force-field *ng*. This cannot be said however for the realization illustrated by FIG. 9, propably because here the diffusion of substance A through substance B occurs in the same direction as the force-field, and in this case we are not sufficiently familiar with the physical phenomena involved. Nevertheless we shall describe the figure. It shows an hermetically sealed vessel 49. In this vessel is a pillar 50 of e.g. porous active coal, suitably encased in a gas-tight envelope or skin 50' which however does not reach all the way to the base of the pillar, nor cover its top surface. Volume 51 in vessel 49 contains (for example) gaseous ammonia. As is well known, ammonia is forcefully adsorbed by active coal. Adsorbtion increase as the temperature falls, which means there are more ammonia molecules crowded onto a unit surface of coal at a lower temperature than at a higher. The whole is subject to force-field *ng*. We will assume first that $n = 1$, that is to say the force-field is equal to earth gravity. Temperature throughout is equal to the ambient temperature $T_0$. The specific weight per unit volume of ammonia within the coal pillar is significantly greater than that of the gas in chamber 51. The ammonia in the coal pillar may be considered as a liquid. When factor $n$ is increased significantly over the value of 1, we may suppose that the concentrated (or perhaps liquid) ammonia in the coal pillar travels downwards. Thus equilibrium is disturbed by the force-field. There is reason to believe that evaporation occurs at the bottom part of the pillar, accompanied by a fall in temperature, wherewith adsorption and a rise in temperature can be expected at the pillars's upper surface. Such a phenomenon has not been observable however, in spite of a value for $n$ of over 2000. Undoubtedly the ammonia molecules are too strongly bound to the coal. It is quite conceivable that ultrasonic waves could act as a lubricant between the ammonia molecules and the coal pillar, but this experiment has not yet been performed. It might be an advantage to replace the coal with fine fibres such as glass, for example, since the ammonia molecules would then travel over smooth surfaces instead of in the matt surfaces of coal. In the event that this phenomenon could be induced using combinations of substances other than those named, it is strikingly similar to the phenomena described in connection with FIGS. 6, 7 and 8. The points $u''$ and $u'$ mentioned previously coincide respectively with the upper and lower ends of the coal pillar. As well as gas A, chamber 51 may contain heavy gas of lesser density than liquid A.

Figure 10:
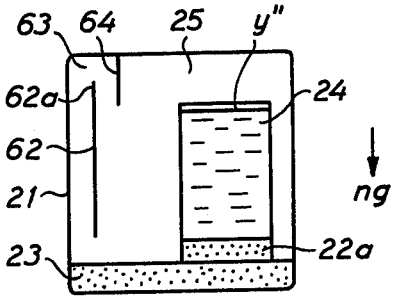

We return now to FIG. 6. The specific weight of the inert gas in the lower part of chamber 25, i.e. in the vicinity of tile 23, is greater than that of the liquid. There is thus a risk that liquid can gather in a layer at some level between the ceiling 21*a* and the tile or floor 23. One could then arrange, as FIG. 10 shows, a porous rod 62 whose upper tip 62*a* extends into a tiny chamber 63 which occupies a very small part of chamber 25. This part 63 is thermally isolated from the remaining, larger portion of chamber 25 by a screen 64. A small quantity of heat may be supplied electrically to the tip 62*a* of rod 62, by which means the liquid in the said layer is taken up in the rod and eventually evaporates off, the vapour then being carried by the force-field *ng* towards the floor 23 where it condenses. It is simpler, however, to do as shown in principle in FIG. 11. The interior 25 of vessel 21 contains (for example) propane, sulphur, hexafluoride and xenon. The pressure of the inert gas mixture is great enough — something up to 100 atm. at room temperature — that a thin layer 55 of propane is always at the ceiling of chamber 25. Under the influence of force-field *ng* propane evaporates from this layer at a certain partial pressure $p_2$ and temperature $T_2$. Propane vapour condenses at the floor of chamber 25 at a certain pressure $p_1$ and temperature $T_1$.

When a drop has formed on the floor and grown large enough for its buoyancy to overcome adhesion, it floats up and joins the liquid layer 55. To facilitate heat transfer from condensing vapour to the floor, the latter may be provided with a large number of small studs 56 of a heat conducting material. They are shown as being pointed upwards, in which case the drops will be fairly small. If the drops are to become larger before detaching themselves, the studs must be made blunt or given other appropriate conformation. Of course the ceiling may be similarly studded to facilitate heat transfer to the liquid layer 55.

Figure 11:
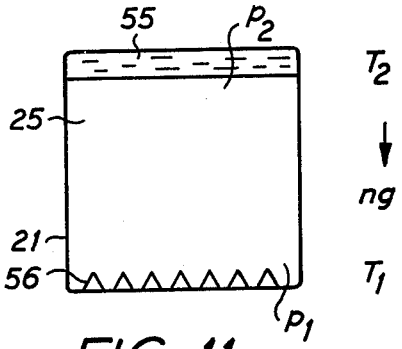
Figure 12:
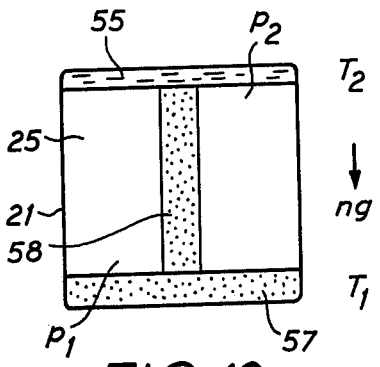

FIG. 12 shows a porous tile 57 of e.g. porcelain covering the bottom of the vessel 21. Standing out of this tile 57 is a porous pillar 58 of porcelain or other material having low thermal conductivity. A layer of fluid propane at the ceiling of the chamber 25 is marked 55 as in FIG. 11. Fluid propane travels out of tile 57, where propane vapour has condensed, through pillar 58 up to the ceiling where it rejoins the layer of liquid 55. The movement occurs because the liquid is lighter than the gas.

In FIGS. 11 and 12 temperature $T_1$ is higher than $T_2$, since pressure $p_1$ is greater than $p_2$. Heat thus passes of itself from a lower to a higher temperature, as long as the force-field *ng* is operative. We have not yet touched on the destructive entropy-increasing process which, if Clausius' theory is generally applicable, must reveal itself if the processes illustrated in FIGS. 6, 10, 11 and 12 should not come within the second law of thermodynamics. Suppose that a symptom of such destructive process is that the pressure and therewith the specific weight of the inert gas (e.g. $SF_6$ and X) may not be great enough to float the fluid propane all the way up to the ceiling of chamber 25 by itself. The liquid must then be pumped up the last part of the way by pump 70, shown schematically in FIG. 13. Pump 70 is thus both suction and pressure pump. The liquid, now somewhat heavier than the gas in the upper part of chamber 25, flows out of the pipe 71 into the trough 72, of which many such can be placed at this level. From trough 72 the liquid evaporates at the lower temperature $T_2$. The vapour diffuses downwards and condenses on the porous tile 57 at the higher temperature $T_1$. It is possible that this destructive process could be intense enough to make Clausius' theory valid in this case also. But it cannot be so intense, that significantly improved efficiency over an ordinary compressor refrigerator cannot be attained. Because condensation at the floor takes place in a higher partial pressure of the gas mixture than evaporation at the ceiling, less heat is emitted at the higher temperature $T_1$ in the course of the thermodynamic cycle — it having been stated that heat released by condensation diminishes under increased pressure of an inert gas. This carries the inescapable conclusion, according to the first law, that to keep the process in function now requires less work.

It may be interesting to note that the inert gas or gas mixture, substance B, behaves as a semi-permeable body which transports substance A when that is a vapour or gas but not when it is a liquid (FIGS. 6, 7, 8, 10, 11, 12 and 13).

In accordance with previous observations, liquid of A (e.g. $H_3N$, $H_2O$) may have higher specific weight than gas of B (e.g. $SF_6$, X) but lower molecular weight. Diffusion will then occur in the opposite direction to force-field *ng*. In FIG. 11 for example, the liquid 55 would lie at the floor instead of the ceiling in vessel 21. Substances A and B are chosen to suit requirements. In the following FIGS. 14 and 15, A and B are assumed to be so chosen that diffusion occurs in the direction of the force-field.

Figure 14:
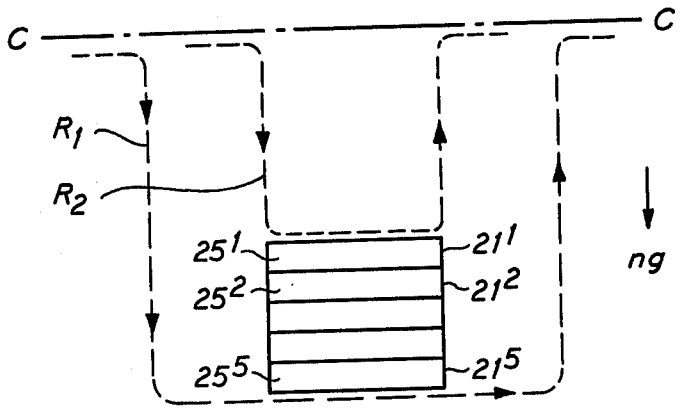
FIG. 14 shows schematically how heat may be conducted to and from a machine functioning according to the invention.

FIG. 14 shows, in principle, a pratical realization of the invention. Several containers $21^1$, $21^2$ etc. are grouped together so that the floor of one is the ceiling of the next. The force-field *ng* is produced by rotation as before. The geometric axis of the axis of rotation is marked C—C. Each container encloses a circular chamber $25^1$, $25^2$ etc. whose geometric axis is the same as the above. The chambers contain propane and inert gas. The force-field *ng* is proportional to the mean radius of each chamber and thus the temperature difference between floor and ceiling, if all the chambers are the same height, will be least in chamber $25^1$ and greatest in the chamber on the periphery, $25^5$ in the drawing. The temperature differences are additive. Heat is supplied to a low temperature $T_2$ by means of the liquid flowing through channel $R_2$, and drawn off from the higher temperature $T_1$ through channel $R_1$. The channels are shown only by dotted lines. The inflow and outflow ends of these channels lie in the immediate proximity of the axis of rotation C—C. To avoid unnecessary energy losses the whole rotates in a high-vacuum chamber, whose housing has not been illustrated.

Figure 15:
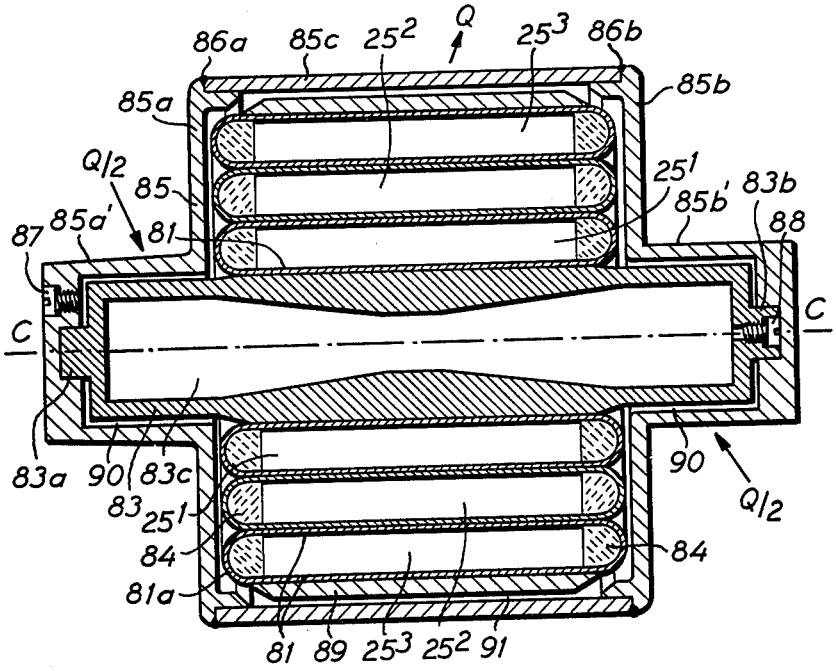
FIGS. 15 and 16 show in principle how a practical realization of the invention may be constructed.
Figure 16:
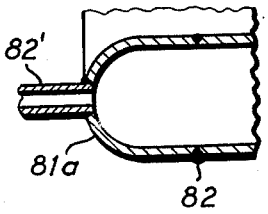

In FIG. 15 the axis of rotation is marked C—C as before. Only three chambers are shown, $25^1$, $25^2$ and $25^3$, though of course the number may be greater. The geometric axis of each chamber coincides with said axis C—C. The material of the wall 81 enclosing each chamber is suitably steel of the highest possible tensile strength. Parts 81*a* to left and right of the drawing are suitably joined to the rest of walls 81 by a seam weld 82 (FIG. 16). The inner wall 81 of chamber $25^1$, i.e. that nearest to axis C—C, rests on or is shrunk onto an axle 83. The inner wall of $25^2$ lies against the outer wall of $25^1$ etc. To the left and right in each such chamber is a plug 84 of glass, porcelain or other material of low thermal conductivity. Each such plug may be divided in sectors to prevent random breakage and destruction (not shown in the drawings). The axle 83 is fitted at its ends 83*a* and 83*b* in a static housing 85. This consists of a part on the right with a similar part on the left, 85*b* and 85*a*, and a central part 85*c* which is hermetically sealed to the said two parts by soldered seams 86*a* and 86*b*. The whole housing is thus hermetically sealed. It communicates with the surroundings only by removal of a screw 87. The extremeties of the housing to left and right are marked 85*a'* and 85*b'*. The axle 83 contains a circular chamber 83*c* whose geometric axis coincides with axis C—C. The diameter of this chamber increases from the centre outwards towards the ends of the axle, giving conical inner surfaces to a part to the left and a part to the right in this chamber. The chamber communicates with its surroundings only by removal of screw 88. The chamber contains a small quantity of a liquid and its vapour, which can be ammonia, propane or any other suitable substance.

Figure 13:
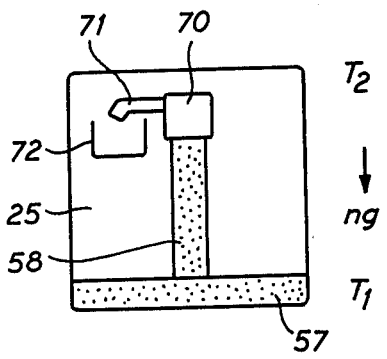

That wall 81 having the greatest diameter rests in a cylinder 89. The wall of this cylinder is thicker and stronger than said wall 81. The ends of axle 83 have a very slightly smaller diameter than the inner diameter of the ends 85*a'* and 85*b'* of housing 85. The gaps 90 are thus very narrow, preferably only a fraction of a millimeter. Similarly the gap between housing 85*c* and cylinder 89 is very small. The volume between the static housing and the body composed of components 83, 81 and 89 rotating about axis C—C, is suitably filled with hydrogen. The pressure of this gas is low but not so low that its thermal conductivity is markedly less than at atmospheric pressure. A fraction of a torr is the right order of magnitude. The chambers $25^1$, $25^2$ etc, contain the same substances A and B as previously named in connection with FIGS. 6, 10, 11, 12 and 13. Substance A can then appropriately be propane and substance B a mixture of xenon and sulphur hexafluoride at the stated pressure. These substances are pumped into each chamber through a short channel 82' (FIG. 16) which is afterwards closed by welding or soldering. A pillar 58 and pump 70 such as shown in FIG. 13 may be used here but is not shown since it is similar. We will assume now for the sake of clarity that the thermodynamic process taking place in a machine such as that in FIG. 15, is that of a complete second law of thermodynamics. Reinforced by the previous arguments, and knowing that the general applicability of Clausius' theory has not been proved, we have the right to make this assumption, which is in the interests of simplifying the description to follow.

The axle 83 and its constituent bodies 81, 84 and 89 may be set in rotation by the same means as the rotor in an ordinary three-phase induction motor. The stator is fixed round part 85*a'* or 85*b'*. In every chamber 25$^1$, 25$^2$ etc. vapour of substance A (eg propane) condenses on the floor, that is to say the surface in the chamber furthest from the axis of rotation C—C, while liquid of the same substance evaporates from the ceiling of the chamber, or the surface nearest the axis of rotation. If the centrifugal force in the outer chamber (25$^3$ in FIG. 15) is in the region of $10^5$ g and the distance between floor and ceiling is 1 cm, there can be a temperature difference between them of 5° to 10° C. This value is dependent upon the mean temperature in the chamber. If it is too little, another substance than propane may be chosen for that particular chamber. Since the mean temperature is higher in the outer chambers it will often be advisable to have different substances A in the different chambers.

A quantity of heat, eg Q/2, enters through each part 85*a'* and 85*b'*, passes easily through the hydrogen in gaps 90 and makes its way in through both ends of the axle 83. Here it causes the liquid of an appropriate substance e.g. ammonia, to boil. The ammonia condenses on the central parts of the wall of chamber 83*c*, wherewith heat at, say, temperature $T_2$, is transferred to the ceiling of the innermost chamber 25$^1$. Ammonia — the condensate — flows back under the action of centrifugal force to the two ends of chamber 83*c*. These could be appropriately joined by a channel, preferably straight and so formed that no more condensate could accumulate in one end of chamber 83*c* than in the other. (Such a channel is not shown in the drawing). The quantity of heat $2 \times Q/2$, i.e. Q, passes from cylinder 89 through gap 91 to the housing 85*c*, and on to where it will be used. The incoming heat has a lower temperature than the outgoing.

Heat conduction from floor to ceiling within each chamber (25$^1$, 25$^2$ etc) is retarded by the presence of bodies 84, whose low thermal conductivity requires the heat to travel the long way round through the metal parts 81*a*.

Suppose that work must be sacrificed to pump liquid A from floor to ceiling in each of the chambers 25. Such a device can be constructed with known means in several ways, all simple, for which reason none are shown in the drawing. It should be added that if work is required it must be introduced into chambers 25 in such a way that they remain hermetically sealed. This could be done electrically, magnetically or with the aid of an elastically resilient membrane. As previously shown, if such work must be sacrificed, the machine at the very best would only indicate an incomplete second-order perpetual motion contrary to Clausius' theory; otherwise it will constitute a refrigeration plant or heat pump of greater efficiency than any such known, but not in contention with the theory.

It may be mentioned that there is advantage to be gained in choosing substance A so that its critical temperature is not too much greater than the temperature in which it will be used, but is of a technically optimum value above the latter. In this way total pressure in the chambers 25 will be minimized, whereby the temperature difference between floor and ceiling will be maximized.

When substance B is an inert gas such as $SF_6$ and X, it is very slightly soluble in the liquid substance A, and to a small extent will share in A's cycle, oscillating between two states of matter, but in the main, the state of matter of substance B is constant.

The temperature difference won by the process can of course be used to drive a steam engine which delivers work. If the process takes place at a very low temperature, say −100° C. or lower, and work is delivered at that mean temperature, heat passes to it from the ambient temperature $T_0$. This transfer of heat can take place via another steam engine, which will thus also deliver work.

I claim:

1. A method of transferring heat energy by means of a cyclic thermodynamic process comprising the steps of:

providing an axis of rotation, providing a plurality of rigid annular containers positioned adjacent one to another concentric about said axis and located at progressively greater radial distances from the axis of rotation, providing good thermal conductivity between said chambers, providing in each of said chambers a mixture of propane and an inert gas sealed therein, mounting said concentric annular chambers in an enclosing hermetically sealed static chamber closely spaced from said annular chambers for defining a narrow gap therebetween, filling said narrow gap with hydrogen, rotating said concentric annular containers at high speed about said axis, allowing heat energy to enter the innermost of said concentric annular chambers, and allowing heat energy to be released from the outermost of said chambers across said gap.

2. The method as claimed in claim 1, including the steps of:

insulating the axial ends of said concentric annular chambers, providing said good thermal conductivity by tightly fitting said annular chambers in concentric relationship one about another.

3. The method as claimed in claim 1, wherein:

said inert gas is a mixture of Xenon and sulphur hexafluoride.

4. The method as claimed in claim 1, including the steps of:

providing a hollow axle extending along said axis of rotation, shrinking the innermost of said concentric chambers about said axle, and filling the hollow in said axle with a liquid and its vapor.

5. A method for transferring energy by means of a cyclic thermodynamic process comprising the steps of:

providing a medium comprising at least two substances A and B, separating substance A from substance B at a first point $u'$ defining a first thermodynamic parameter and allowing the medium to release energy during said separating at said first point $u'$, combining substance A with substance B at a second point $u''$ defining a second thermodynamic parameter and which point is positioned remote from said first point $u'$ and allowing the medium to absorb energy during said combining at said second point $u''$, providing a circulation channel for the medium between said first and second points, applying a force field to the medium for maintaining a predetermined differential in the total pressure of the medium at said first and second points, and inducing the separation and combination of the substances A and B by diffusion therebetween, whereby energy is transferred from the second point $u''$ to the first point $u'$.

6. The method as claimed in claim 5 wherein substance A passes through at least two states of matter during the course of said cyclic process.

7. The method as claimed in claim 2, wherein the substance A comprises the group including ammonia ($H_3N$) and propane ($C_3H_8$).

8. The method as claimed in claim 2, wherein said two states of matter are gas and liquid.

9. The method as claimed in claim 5, wherein substance B during said cyclic process remains essentially at one and the same state of matter.

10. The method as claimed in claim 5, wherein substance B is an inert gas.

11. The method as claimed in claim 5, wherein substance B is a solid body.

12. The method as claimed in claim 5, wherein B is a substance dissolved in substance A, and belonging in the group comprising NaJ, Kj, $LiNO_3$, $NH_4NO_3$.

13. The method as claimed in claim 5, wherein the molecular weights of the substances A and B are so chosen that they are different.

14. The method as claimed in claim 5, wherein substances A and B are so chosen that substance B behaves with substance A as a semi-permeable body.

15. Apparatus for transferring heat energy by means of a cyclic thermodynamic process comprising:

an axle mounted in bearing means and rotatable about an axis, means of high tensile strength defining a plurality of hermetically sealed rigid annular containers positioned adjacent one to another concentric about said axis and located at progressively greater radial distances from the axis of rotation, the innermost of said concentric chambers being mounted on said axle and the outermost of said chambers being encircled by a strong cylinder, said concentric chambers having good thermal conductivity therebetween in the radial direction, means thermally insulating the axial ends of said concentric chambers, said chambers having sealed therein a mixture of propane and an inert gas, means defining a hermetically sealed static chamber enclosing said axle and said concentric annular chambers, said static chamber being closely spaced about said concentric annular chambers defining a narrow gap between said static chamber and said concentric chambers, hydrogen in said narrow gap, and said axle with said concentric chambers mounted thereon being adapted to be rotated at high speeds as the rotor of a multiphase induction motor.

16. Apparatus for transferring heat energy by means of a cyclic thermodynamic process as claimed in claim 15, in which:

said axle has a greater length in an axial direction than said concentric chambers mounted thereon thereby having opposite ends extending beyond the axial ends of said concentric chambers, said static chamber has axial extensions enclosing the opposite ends of said axle, and the opposite ends of said axle are adapted to be driven as the rotor of a multiphase induction motor.

17. Apparatus for transferring heat energy by means of a cyclic thermodynamic process as claimed in claim 16, in which:

said axle has an axial chamber therein concentric with said axis of rotation, said axial chamber increasing in diameter outwards towards the opposite ends of said axle forming symmetrical inner conical surfaces diverging toward opposite ends of the axle, and a small quantity of liquid and its vapor in said axial chamber.

* * * * *

UNITED STATES PATENT OFFICE

CERTIFICATE OF CORRECTION

Patent No. 4,084,408 Dated 4/18/78

Inventor(s) Baltzar Von Platen

It is certified that error appears in the above-identified patent and that said Letters Patent are hereby corrected as shown below:

[30] Foreign Application Priority Data:

October 5, 1973 Sweden.....7313575-8

November 7, 1973 Sweden.....7315092-2

Col. 2, line 12, change "quality" to--qualify--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*

UNITED STATES PATENT OFFICE

CERTIFICATE OF CORRECTION

Patent No. 4,084,408 Dated 4/18/78

Inventor(s) Baltzar Von Platen

It is certified that error appears in the above-identified patent and that said Letters Patent are hereby corrected as shown below:

[57] Abstract, line 5, change " w' " to--u'--.

Abstract, line 7, change " w" " to--u"--.

Col. 6, line 52, change "AT" to--At--.

Col. 6, line 52, change "or" to--of--.

Col. 6, line 55, change "a$\beta$-molecules" to--$\alpha$-molecules--.

Col. 7, line 16, change "a-molecules" to--$\alpha$-molecules--.

Col. 8., line 33, change "If" to--Its--;

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*